United States Patent [19]

Everman et al.

[11] Patent Number: 4,537,584

[45] Date of Patent: Aug. 27, 1985

[54] METHOD AND APPARATUS FOR FORMING PLASTIC LINERS AND INSERTING THEM INTO BULK CONTAINERS

[75] Inventors: Wayne F. Everman; D. Michael Lewis; Raymond L. Russell, all of Cedar Falls, Iowa

[73] Assignee: Container Corporation of America, Chicago, Ill.

[21] Appl. No.: 563,290

[22] Filed: Dec. 19, 1983

[51] Int. Cl.[3] ..... B31B 7/00

[52] U.S. Cl. ..... 493/93; 493/95; 493/101; 53/175; 53/384

[58] Field of Search ..... 493/95, 100, 97, 101; 53/175, 382, 384

[56] References Cited

U.S. PATENT DOCUMENTS

| | | | |
|---|---|---|---|
| 2,394,935 | 2/1946 | Palmer | 493/95 |
| 4,052,931 | 10/1977 | Morse et al. | 493/101 |
| 4,083,293 | 4/1978 | Goldstein | 493/100 |
| 4,089,255 | 5/1978 | Akoh et al. | 493/100 |
| 4,142,453 | 3/1979 | Gidewall et al. | 493/162 |
| 4,280,313 | 7/1981 | Akkala et al. | 53/175 |

*Primary Examiner*—Daniel C. Crane
*Assistant Examiner*—David B. Jones
*Attorney, Agent, or Firm*—Richard W. Carpenter

[57] ABSTRACT

A method and apparatus for forming a plastic liner bag from a roll of plastic sleeve material and inserting the liner bag snugly within and over the upper edges of a bulk container.

9 Claims, 12 Drawing Figures

METHOD AND APPARATUS FOR FORMING PLASTIC LINERS AND INSERTING THEM INTO BULK CONTAINERS

BACKGROUND OF THE INVENTION

1. Field of the Invention

This invention relates generally to liner bag inserting equipment and more particularly to an improved method and apparatus for forming a plastic lining, in the form of a bag, and inserting it into an open top bulk container.

2. Description of the Prior Art

A prior art search in the United States Patent and Trademark Office directed to the subject matter of this application disclosed the following U.S. Pat. Nos. 2,364,012; 2,678,764; 3,126,797; 3,266,390; 3,314,210; 3,393,842; 3,523,492; 3,653,111; 3,710,693; 3,735,557; 3,762,023; 3,897,674; 4,052,931; 4,083,293; 4,089,255; 4,142,453.

None of the prior art patents uncovered in the search discloses a method or apparatus wherein a liner is formed from continuous plastic sleeve material in the shape of inverted bag, with the open end of the liner being cuffed over the upper end of the container, and the remaining portion of the liner being positioned within the container against the inner surfaces of the container.

SUMMARY OF THE INVENTION

An object of the present invention is to provide a new and improved method and apparatus for lining large bulk type containers.

A more specific object of the invention is the provision of a liner forming and inserting apparatus which will form a liner bag from continuous plastic sleeve material and draw the open end over the top of the container to form a cuff, with the remaining portion of the bag being positioned against the inner surfaces of the sides and bottom of the container.

A more specific object of the invention is the provision of particular cutting and sealing apparatus for forming bags from plastic material.

Another more specific object of the invention is the provision of means to open the lower end of an inverted bag, spread it, and cuff it over the upper end of an open container.

Yet another specific object of the invention is the provision of means for positioning a liner bag against the inner surfaces of the container after the upper end of the liner bag has been cuffed over the upper end of the container.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
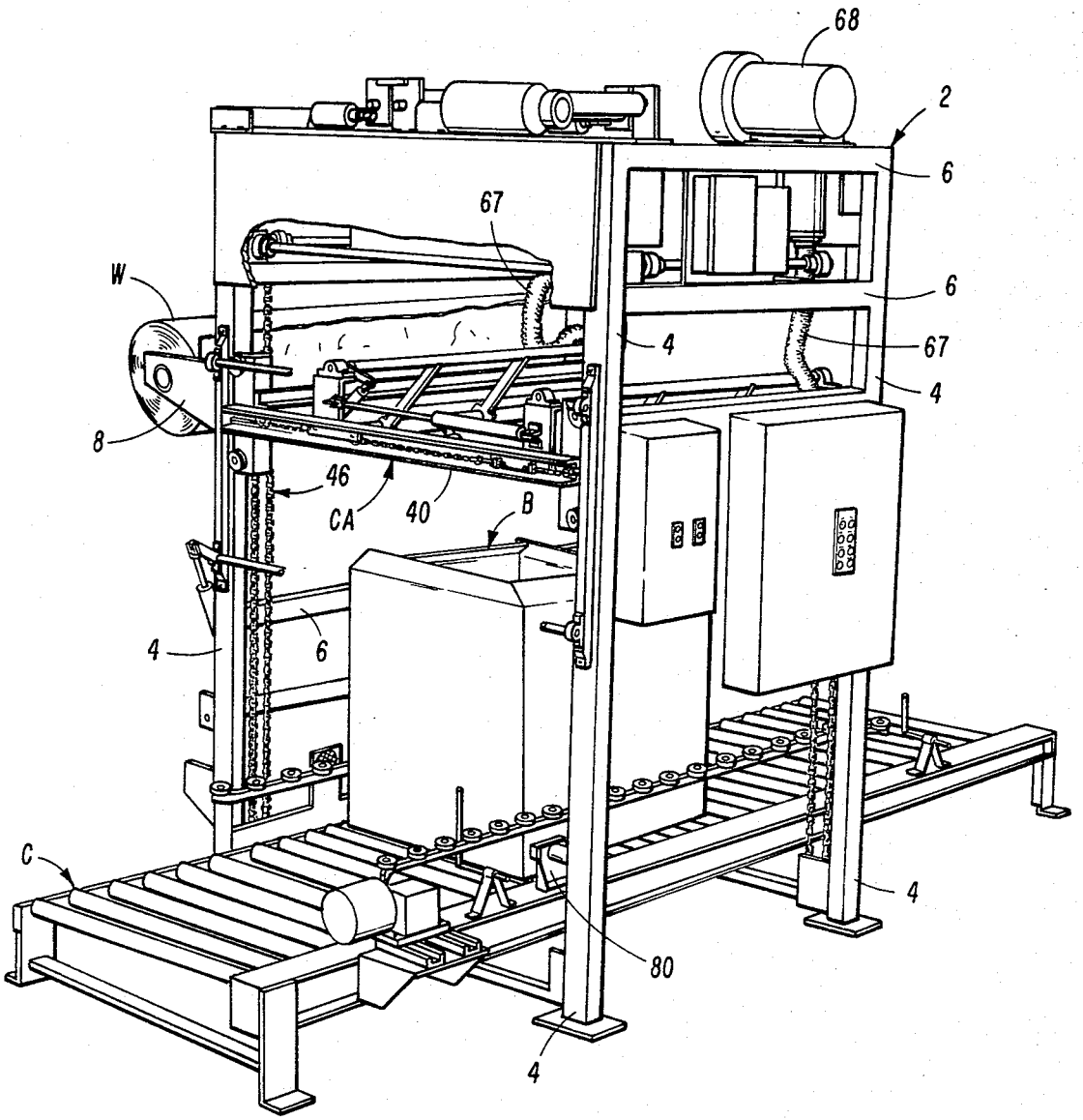
FIG. 1 is a perspective view of a liner bag forming and inserting apparatus embodying features of the invention.
Figure 2:
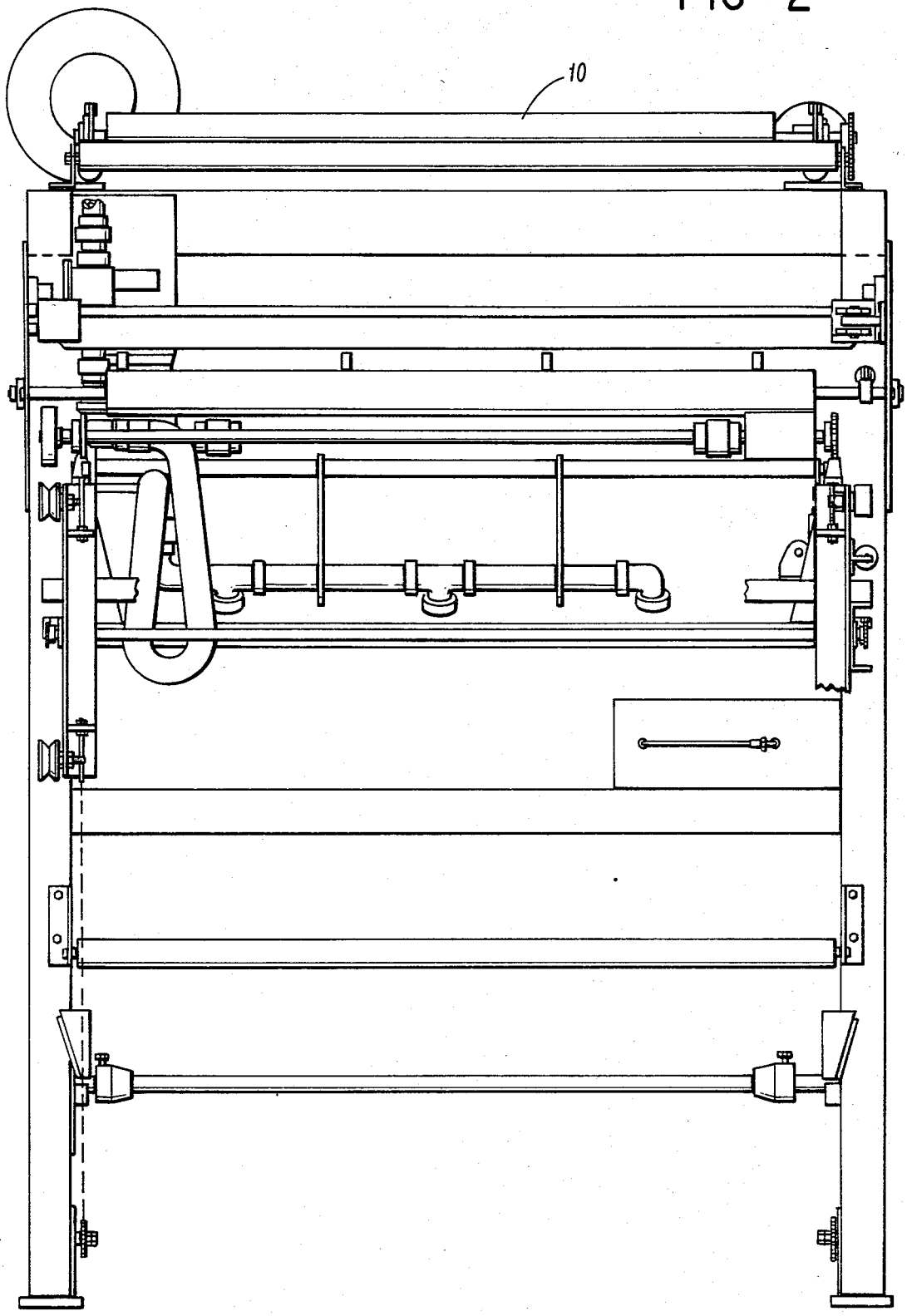
FIG. 2 is a side elevational view of the structure illustrated in FIG. 1.
Figure 3:
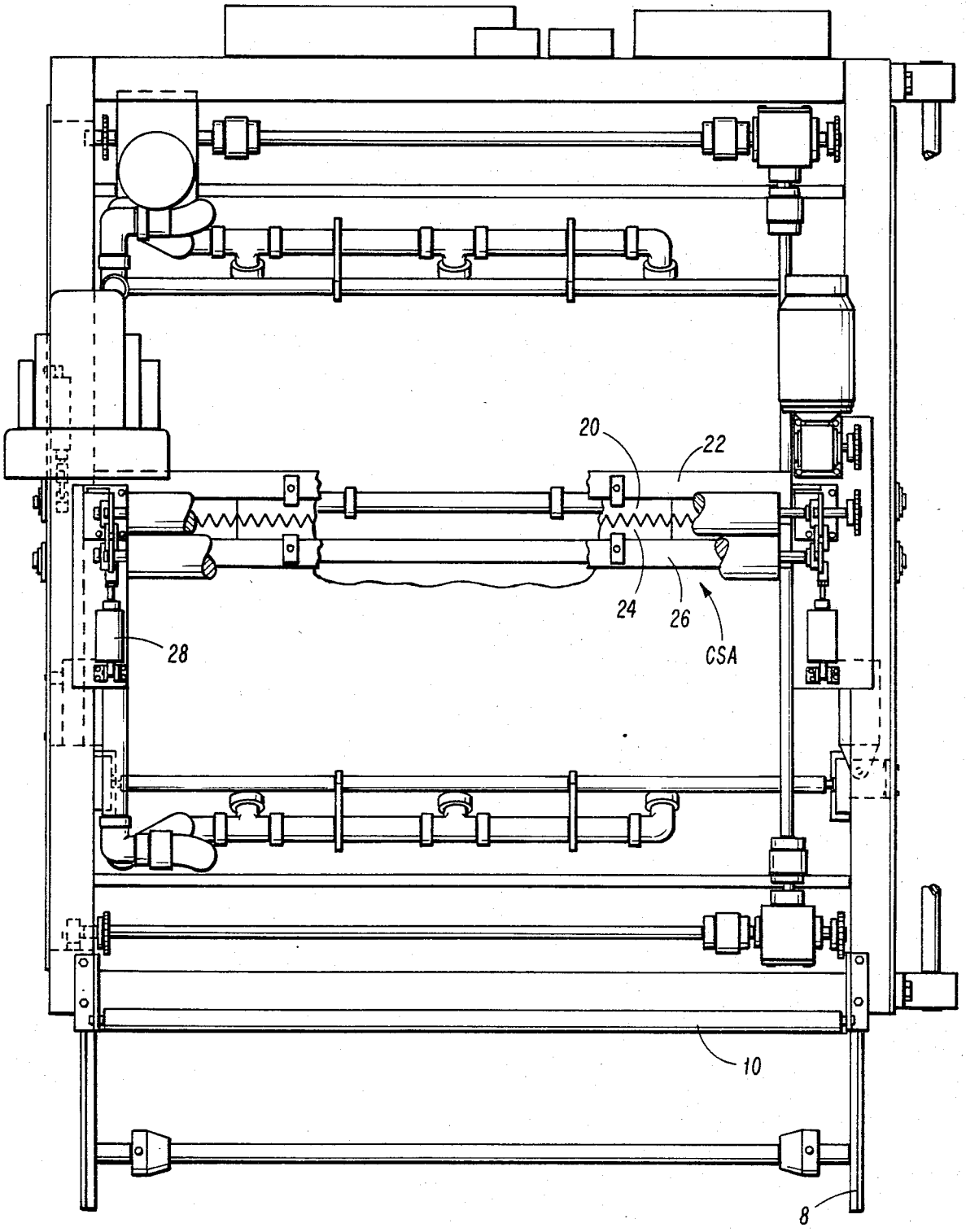
FIG. 3 is a top plan view of the structure illustrated in FIG. 1.
Figure 12:
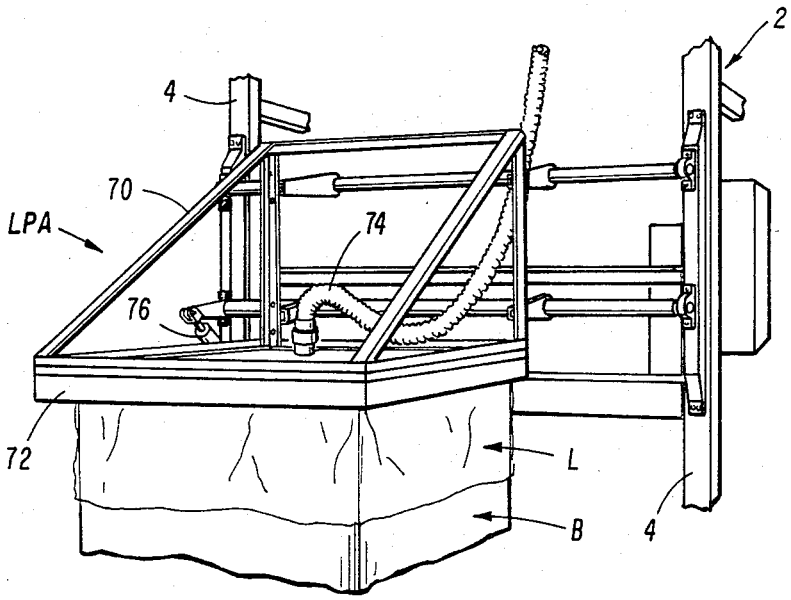
FIG. 12 is a fragmentary perspective view of the liner bag positioning mechanism of the apparatus of the invention.

Referring now to the drawings for a better understanding of the invention, and particularly to FIGS. 1 and 12, it will be understood that the purpose of the apparatus shown therein is to form a container liner bag from plastic sleeve material and insert it into a container, with the liner bag disposed against the inner surfaces of the container. The container may be of any type, such as the corrugated paperboard bulk bin indicated generally at B in the drawings.

The liner, indicated generally at L, is in the form of a plastic bag formed from preferably gusseted plastic sleeve material. The liner bag forming and inserting apparatus includes a frame structure, indicated generally at 2, that is positioned over a conveyor, indicated generally at C, which serves to deliver containers to the inserting apparatus and remove them therefrom.

Frame 2 includes a plurality of vertical members or columns 4 which are interconnected by horizontal members or beams 6. Mounted on one side of frame 2 are brackets 8 adapted to hold one or more rolls of plastic sleeve material in web form, indicated generally at W.

Figure 4:
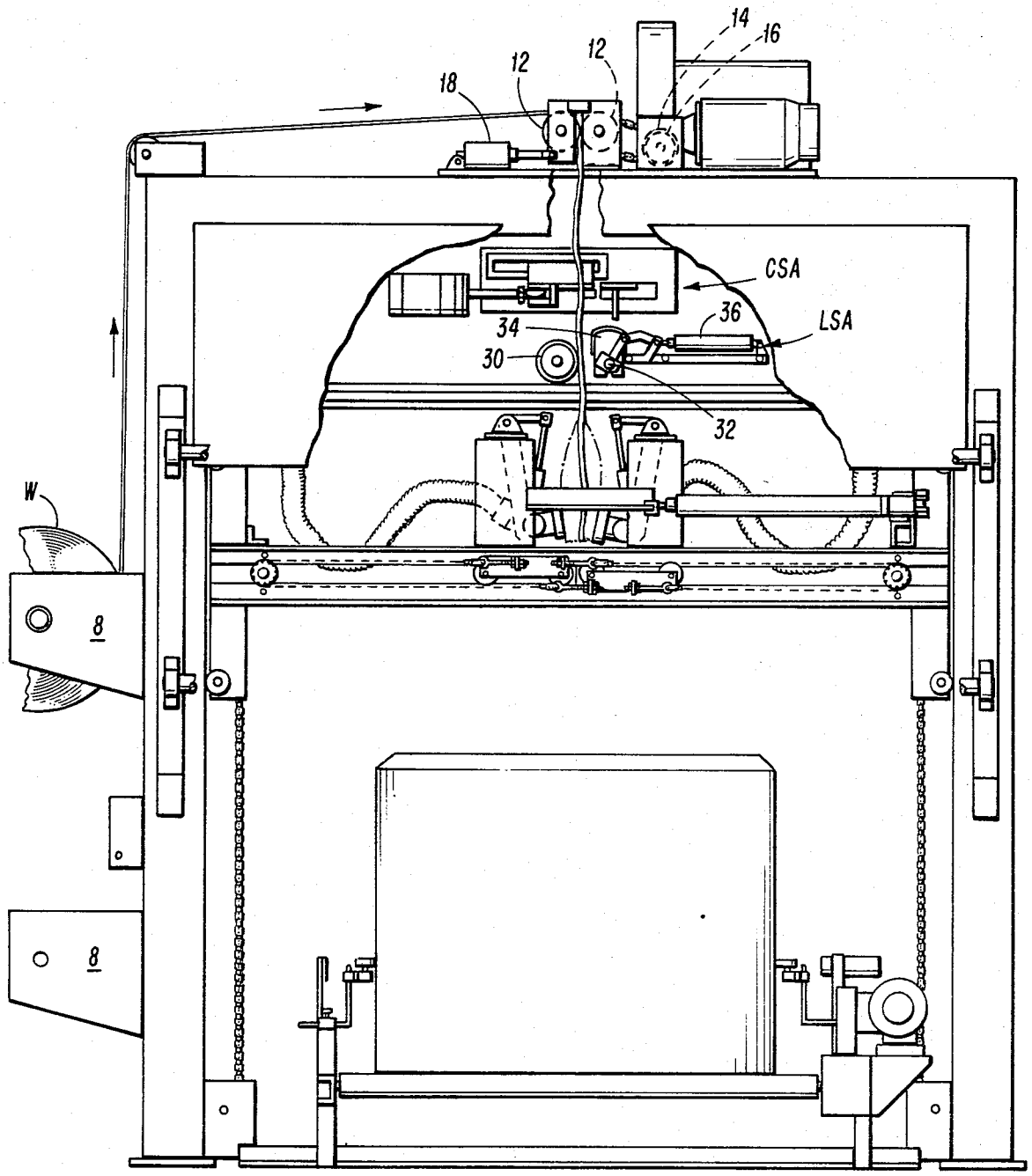
FIGS. 4, 5, 6, and 7 are end elevational views of the structure illustrated in FIG. 1, with the apparatus shown in the various positions of operation.
Figure 5:
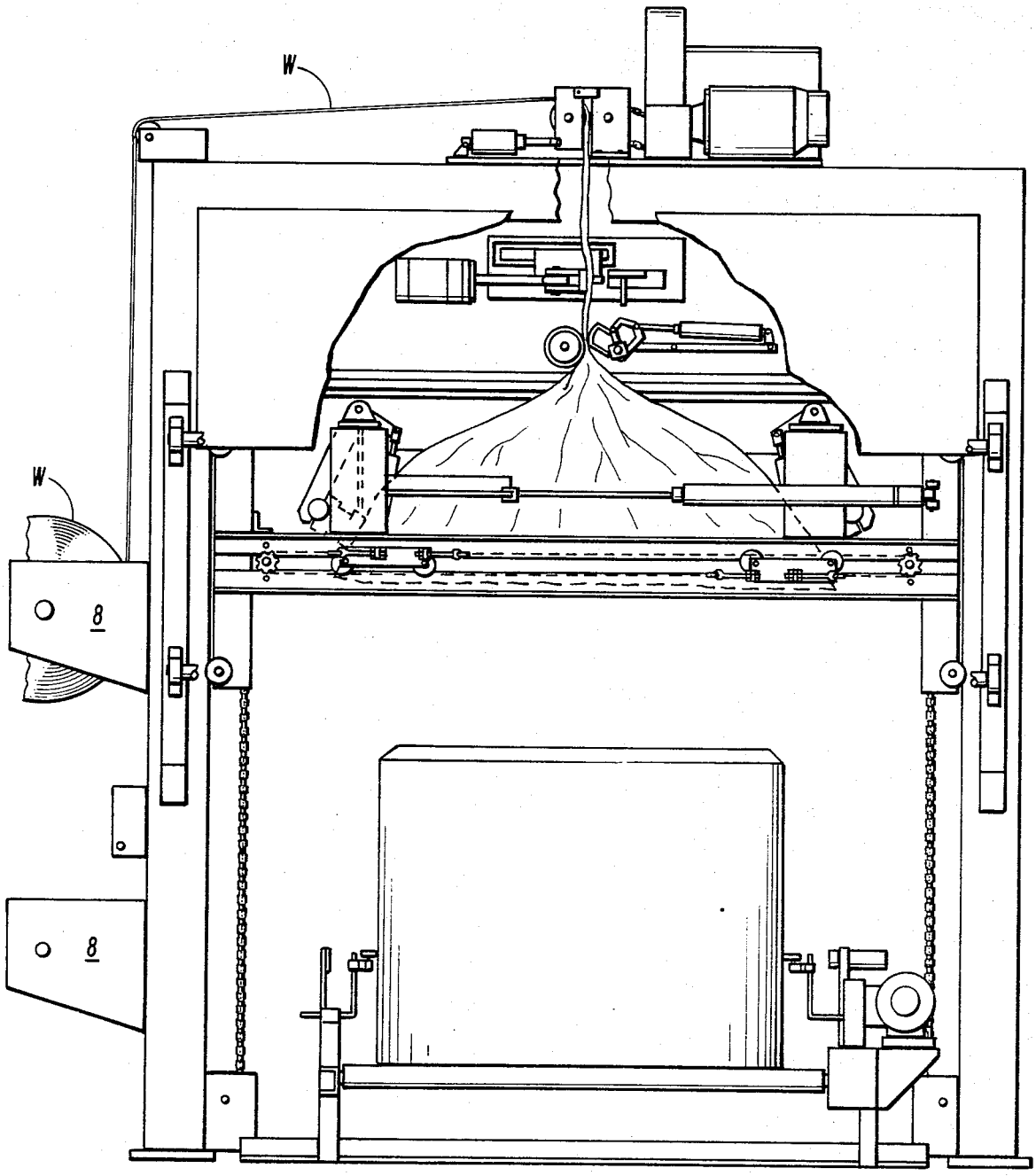
Figure 6:
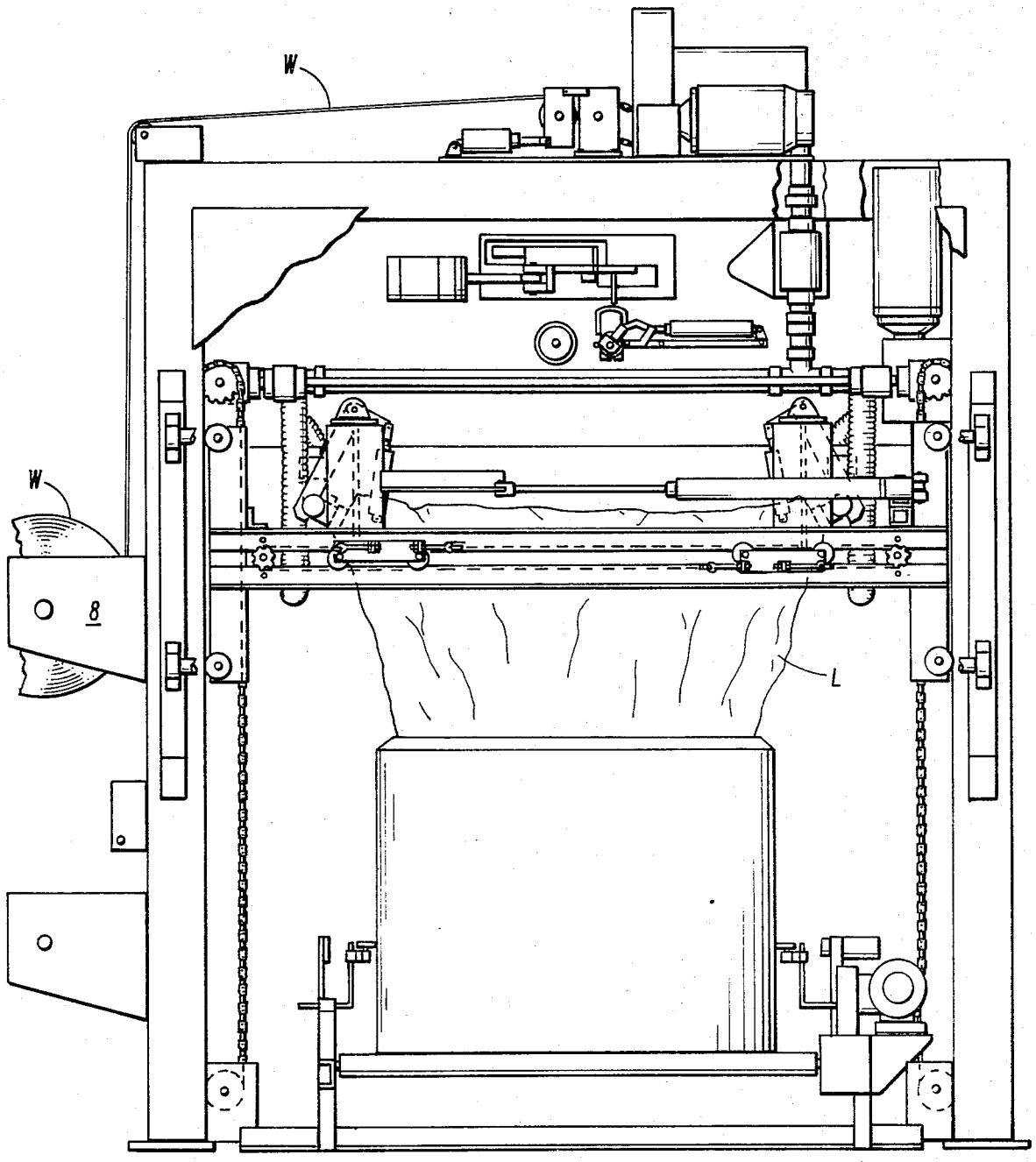
Figure 7:
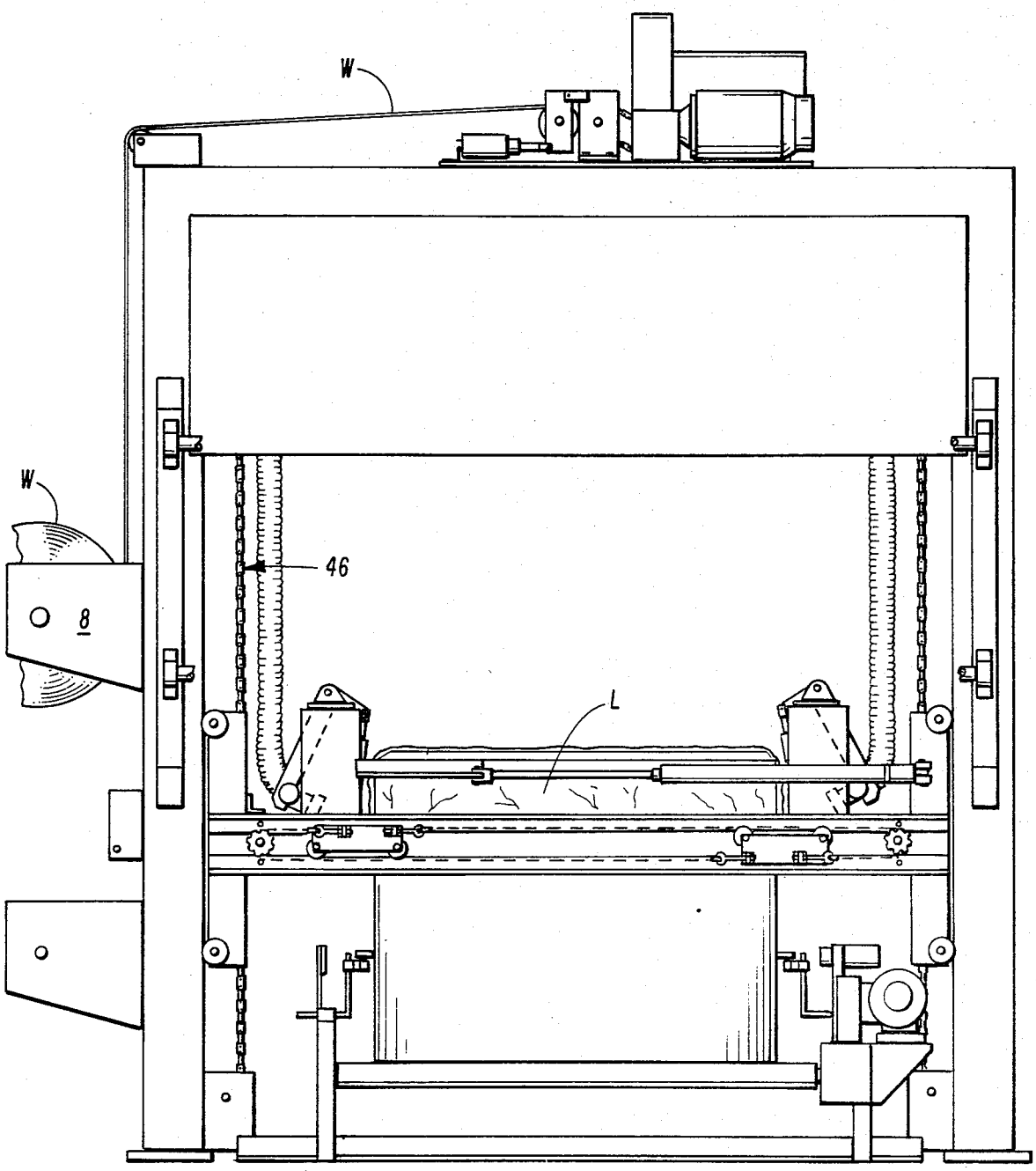
Figure 8:
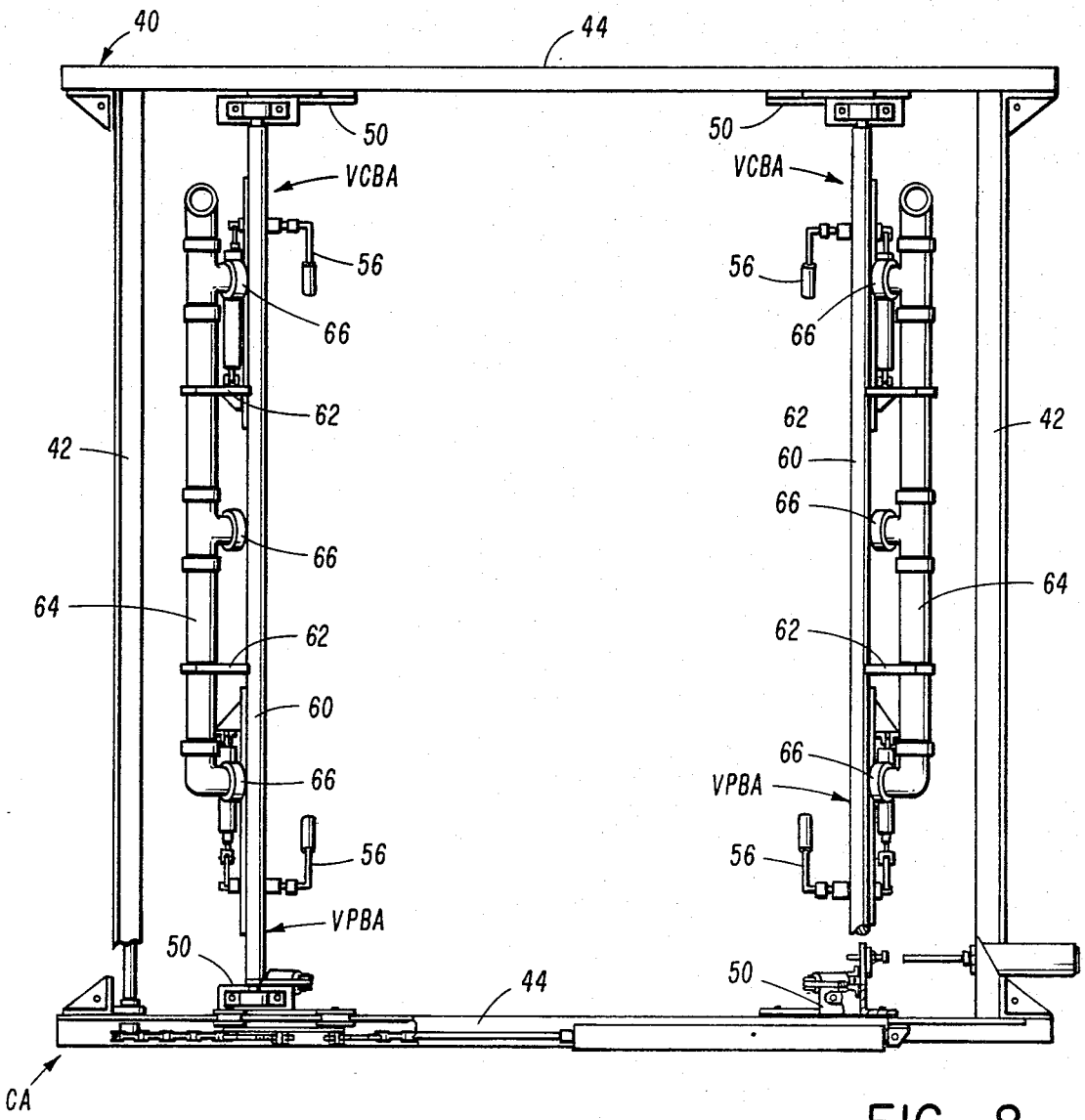
FIG. 8 is a top plan view of the carriage assembly of the apparatus illustrated in FIG. 1.
Figure 9:
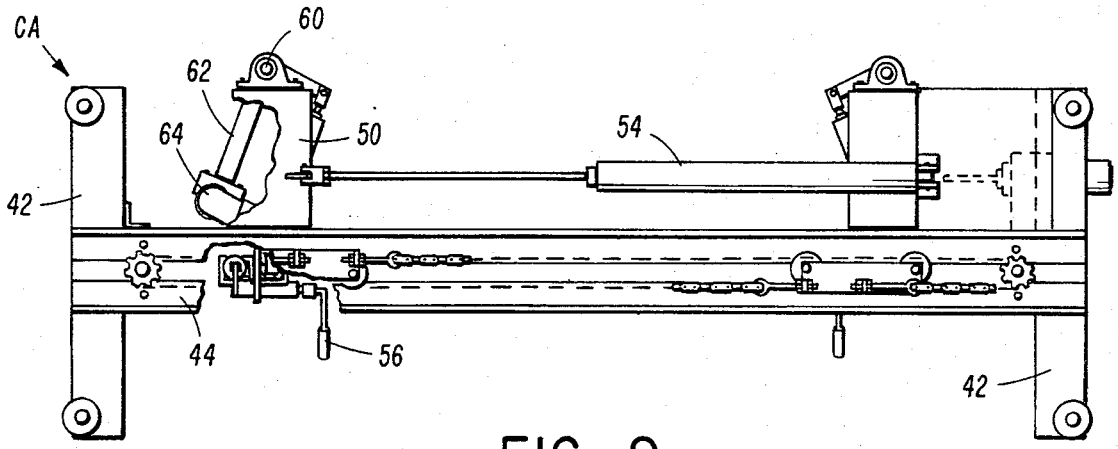
FIG. 9 is an end elevational view of the structure illustrated in FIG. 8.
Figure 10:
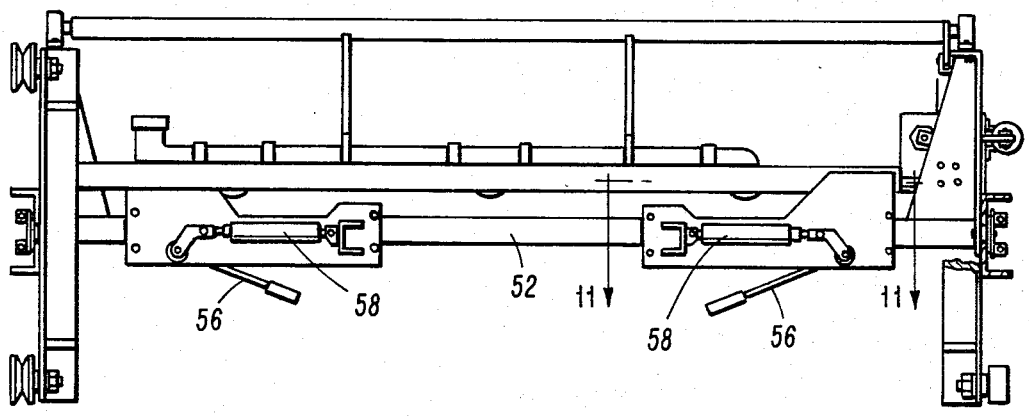
FIG. 10 is a side elevational view of the structure illustrated in FIG. 8.
Figure 11:
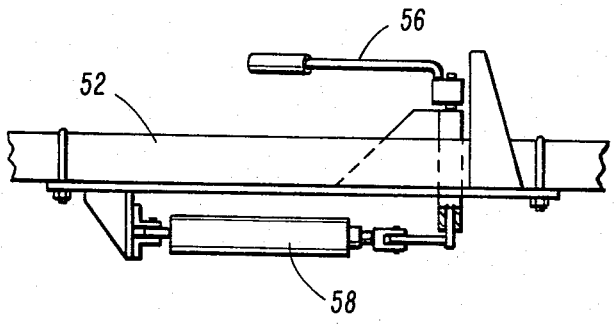
FIG. 11 is a fragmentary top plan view of a portion of the structure taken on line 11—11 of FIG. 10.

Referring now to FIG. 4, it will be seen that mounted on an upper corner of frame 2 is a horizontally disposed idler position roller 10 over which the web W of plastic material passes as it enters between a pair of feed rollers 12 that are driven by a motor 14 and drive 16. An air cylinder 18 is provided to move one roller toward and away from the other.

Mounted below the liner material feed rollers is a liner material cutting and sealing assembly, indicated generally at CSA, which comprises fixed and a movable structures. The fixed structure includes a serrated knife 20 and attached heater bar 22; while the movable structure includes another matching serrated knife 24 and a pressure bar 26. An air cylinder 28 moves knife 24 and pressure bar 26 toward and away from knife 20 and heater bar 22 to sever a predetermined length of plastic from the remainder of the web and also to seal one end of the severed length and thereby form liner L into the shape of an inverted bag.

Mounted just below cutting and sealing assembly CSA is a liner stripper assembly, indicated generally at LSA. The liner stripper assembly includes an idler backup roller 30 positioned adjacent a shaft 32 on which are mounted a plurality of rubber lugs 34. Shaft 32 is rotated by an air cylinder 36 causing lugs 34 to move toward the backup roller 30 and thereby grasp the cut length of liner material and pull it downwardly and away from the cutting and sealing assembly CSA in a manner hereinafter described in connection with the operation of the apparatus.

Also mounted on the frame below the liner stripper LSA is a carriage assembly indicated generally at CA. As best seen in FIGS. 8–11, the carriage assembly CA includes a vertically movable carriage, indicated generally at 40, which comprises a pair of longitudinal members 42 and another pair of transverse members 44 secured together to provide a carriage structure adapted to be moved up and down by means of a drive train indicated generally at 46.

Mounted at opposite sides of the carriage 40 are a pair of vacuum carrier bar assemblies, each indicated at VCBA. Each of the vacuum carrier bar assemblies includes a pair of end structures or brackets 50, between which extends a non-rotatable but laterally slidable, spreader bar 52. Bars 52 are moved toward and away from each other in a manner hereinafter described by means of an air cylinder indicated generally at 54. Carried adjacent the ends of the spreader bars 52 are fingers 56 which are mounted on horizontal axes for rotative movement by an air cylinder 58. The purpose of the fingers is described later in the specification.

Also mounted on each of the vacuum carrier bar assemblies is a vacuum pivot bar assembly, indicated generally at VPBA. Each of the vacuum pivot bar assemblies includes a pivot bar 60 the ends of which are rotatably mounted in end structures 50. Integrally secured to each of the pivot bars 60 are a pair of arms 62 which in turn carry at their lower ends a vacuum manifold 64 having a plurality of vacuum heads 66. The manifolds 64 of each of the vacuum pivot bar assemblies are connected by air lines 67 to a vacuum pump assembly 68 which can be mounted on the frame structure 2.

Referring now to FIGS. 12 and 1, it will be seen that a liner positioning assembly, indicated generally at LPA, is shown as attached to the general frame structure 2 at the container discharge end of the frame structure over conveyor C, shown in FIG. 1. Liner positioning assembly LPA includes a generally rectangular frame 70 having on the underside thereof a platen 72 adapted to form a generally air-tight seal when it is placed over a container having a liner therein. Platen 72 is connected by an air line 74 to the exhaust side of the previously mentioned vacuum pump assembly 68. The frame and platen are adapted to be moved pivotally on a horizontal axis into and out of contact with a container. Movement of the platen is accomplished by an air cylinder 76. The operation of the device is best understood by referring to FIGS. 4–7 and 12 of the drawings. As a container B is moved under the apparatus on conveyor C and moves under the carriage assembly CA, the container passes a photo-electric cell 80 to start the cycle in which a liner bag is formed above the container and inserted therein.

The driven feed rollers 12, mounted atop frame structure 2, move the free end of the web W of plastic sleeve material over the idler positioning rollers 10 and downwardly below the cutting and sealing assembly CSA and also below the vacuum pivot bar assembly VPBA until there is a sufficient length of material to extend down to the vacuum heads 66. At this time the cutting sealing assembly and vacuum pivot bar assembly are each in an open position.

Then the vacuum carrier bar assemblies on the carriage, which is then in its uppermost position are moved toward each other, and the vacuum pivot assembly also closes. A vacuum is drawn in the manifold as the heads 66 engage both sides of the lower end of the plastic sleeve.

Next the vacuum pivot bar assembly opens, moving the vacuum heads apart to open the lower end of the plastic sleeve. At aproximately the same time the fingers 56 engage the four corners of the sleeve and spread open the sleeve wide enough to permit it to be drawn over the top of container B to form a cuff.

The feed rollers 12 are again driven to feed more of the sleeve material toward the container to provide the predetermined length of material required for lining the containerboard and cuffing it over the upper end thereof.

The cutting and sealing assembly is then closed, and simultaneously the length of material is cut from the web, and the edges are sealed together to form an inverted plastic bag.

Then the liner stripper assembly LSA is actuated and engages and pulls the cut bag away from the remaining portion of the material allowing the bag to drop by force of gravity into the container.

Next the carriage is lowered drawing the open end of the bag over the outside of the container to form a cuff. After this has been done the fingers release the plastic material. Then the carriage is returned to its upper position for another cycle.

The container is then moved out from under the carriage to a position under the liner positioning assembly LPA. At the same time another container is moved under the carriage for insertion of a liner.

Platen 72 is then lowered over the top edge of the container and the plastic cuff, and air is injected under pressure into the container to position the liner against the inner surface of the side and bottom walls of the container.

After this has been accomplished the platen is lifted, and the container is moved out, so the next container can be moved from under the carriage to the position under the liner positioning apparatus to repeat the cycle.

What is claimed is:

1. Apparatus for forming, from continuous plastic sleeve material, an inverted plastic liner bag, closed at the top and open at the bottom, and inserting it into an open top container, comprising the combination of:

(a) a frame structure;

(b) a carriage assembly mounted for vertical movement on said frame structure;

(c) dispensing means mounted on an upper portion of said frame structure for engaging and moving downwardly a continuous web of plastic sleeve material past cutting and sealing means toward said carriage, said dispensing means being operable to feed the continuous web a predetermined length with the downwardly leading end of the web adjacent the carriage assembly;

(d) cutting and sealing means mounted on said frame structure for cutting from said web said predetermined length of plastic sleeve material and for sealing an upper end of said length to form an inverted bag;

(e) said carriage assembly including a pair of laterally movable inserting means for grasping and spreading open the downwardly leading end of said inverted bag and drawing it over an upper open end of said container to form a cuff while the remaining sealed end of the bag is free to fall by gravity into said container;

(f) bag positioning means for covering the upper open end of the container and forcing air into the bag to urge said bag against the inner surfaces of the container.

2. Apparatus according to claim 1, wherein said dispensing means is mounted on said frame structure and comprises:

(a) means for holding a roll of plastic sleeve material in web form;

(b) a pair of feed rollers mounted on top of said frame structure and operable to pull said web of material from said roll and move it past said cutting and sealing means and into said inserting means.

3. Apparatus according to claim 1, wherein said cutting and sealing means comprises a fixed structure, including a cutting knife and a heater bar, and a movable structure, including another cutting knife and another pressure bar.

4. Apparatus according to claim 1, wherein said inserting means comprises:

(a ) a vertically movable carriage mounted on said frame;

(b) laterally movable spreader means mounted on said carriage and including:

(i) vacuum head means engageable with said liner bag to open it;

(ii) finger means for grasping and spreading said open liner bag so it can be drawn over said container upper to form a cuff end as said carriage is lowered.

5. Apparatus according to claim 4, wherein said vacuum head means includes a pair of vacuum manifolds mounted on horizontal axes for pivotal movement toward and away from each other.

6. Apparatus according to claim 4, wherein said finger means includes opposed pairs of fingers mounted on horizontal axes for pivotal movement toward and away from each other.

7. Apparatus according to claim 1, wherein said positioning means comprises:

(a) a platen mounted for movement into and out of sealing engagement with the upper end of said container after said liner bag has been inserted therein;

(b) means for introducing air under pressure into said liner bag to urge said bag against the inner surfaces of said container.

8. Apparatus according to claim 7, wherein said platen is mounted on one side of said frame structure for pivotal movement about a horizontal axis.

9. Apparatus for forming, from continuous plastic sleeve material, an inverted plastic liner bag, closed at the top and open at the bottom, and inserting it into an open top container, comprising the combination of:

(a) a frame structure;

(b) a carriage assembly mounted for vertical movement on said frame structure;

(c) dispensing means mounted on an upper portion of said frames for engaging and moving downwardly a continuous web of plastic sleeve material past cutting and sealing means toward said carriage, said dispensing means being operable to feed the continuous web a predetermined length with the downwardly leading end of the web adjacent the carriage assembly;

(d) cutting and sealing means mounted on said frame structure for cutting from said web said predetermined length of plastic sleeve material and for sealing an upper end of said length to form an inverted bag;

(e) said carriage assembly including laterally movable inserting means for grasping and spreading open the downwardly leading end of said inverted bag and drawing it over an upper open end of said container to form a cuff while the remaining sealed end of the bag is free to fall by gravity into said container;

(f) bag positioning means for covering the upper open end of the container and forcing air into the bag to urge said bag against the inner surfaces of the container;

(g) said inserting means comprising a pair of spreader members mounted on opposite sides of the carriage for lateral movement toward and away from each other and each including:

(i) vacuum head means engageable with said liner bag to open it;

(ii) movable finger means for grasping and spreading said open liner bag so that it can be drawn over the open upper end of said container to form a cuff as said carriage is lowered.

* * * * *